US008298007B2

(12) United States Patent
Taguchi

(10) Patent No.: US 8,298,007 B2
(45) Date of Patent: Oct. 30, 2012

(54) RF PLUG CONNECTOR, RF RECEPTACLE CONNECTOR, AND RF CONNECTOR

(75) Inventor: Hiroyuki Taguchi, Tokyo (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 13/185,220

(22) Filed: Jul. 18, 2011

(65) Prior Publication Data

US 2011/0275243 A1 Nov. 10, 2011

Related U.S. Application Data

(63) Continuation of application No. PCT/JP2010/000559, filed on Jan. 29, 2010.

(30) Foreign Application Priority Data

Jan. 30, 2009 (JP) ..... 2009-020264

(51) Int. Cl.
*H01R 9/05* (2006.01)

(52) U.S. Cl. ..... 439/578

(58) Field of Classification Search ..... 439/578, 439/581, 63; 29/876
See application file for complete search history.

(56) References Cited

U.S. PATENT DOCUMENTS

| | | | | |
|---|---|---|---|---|
| 6,474,995 | B1 * | 11/2002 | Wu | 439/63 |
| 6,902,408 | B2 * | 6/2005 | Yamane | 439/63 |
| 7,008,235 | B2 * | 3/2006 | Watanabe | 439/63 |
| 7,118,383 | B2 * | 10/2006 | Nagata et al. | 439/63 |
| 7,334,327 | B1 * | 2/2008 | Chen et al. | 29/876 |
| 7,976,315 | B2 * | 7/2011 | Zuinen et al. | 439/63 |
| 7,993,144 | B2 * | 8/2011 | Hu et al. | 439/63 |
| 8,123,555 | B2 * | 2/2012 | Chen | 439/578 |
| 2006/0141811 | A1 | 6/2006 | Shichida et al. | |

FOREIGN PATENT DOCUMENTS

| | | | |
|---|---|---|---|
| JP | 2001-035606 | A | 2/2001 |
| JP | 2001-307842 | A | 11/2001 |
| JP | 2006-066281 | A | 3/2006 |
| JP | 2006-185773 | A | 7/2006 |
| JP | 2006-318936 | A | 11/2006 |

* cited by examiner

*Primary Examiner* — Alexander Gilman
(74) *Attorney, Agent, or Firm* — Sughrue Mion, PLLC

(57) ABSTRACT

Provided is an RF plug connector which includes: a conductive terminal portion; and an annular conductive coaxial portion that is arranged around the terminal portion, wherein a pair of conductive lead portions extending in the same direction is provided at the outer circumference of the coaxial portion, the terminal portion comprises a lead portion that is arranged between the pair of lead portions so as to be parallel to an extension direction thereof, and impedance control is performed by adjusting the distance between the lead portion of the terminal portion and the lead portions of the coaxial portion.

6 Claims, 6 Drawing Sheets

RF PLUG CONNECTOR, RF RECEPTACLE CONNECTOR, AND RF CONNECTOR

CROSS REFERENCE TO RELATED APPLICATIONS

This application is a continuation application based on a PCT Patent Application No. PCT/JP2010/000559, filed Jan. 29, 2010, whose priority is claimed on Japanese Patent Application No. 2009-020264 filed Jan. 30, 2009, the entire content of which are hereby incorporated by reference.

BACKGROUND OF THE INVENTION

1. Field of the Invention

The present invention relates to a structure of a connector for connecting an RF module and an antenna in an internal component of an electronic device, and relates to a structure of a connector in which the high-frequency characteristics are improved compared to a conventional connector, and further high-frequency response is possible.

2. Description of the Related Art

As a type of coaxial connector, a coaxial connector is known in which an annular space and a cable housing portion are in communication, a cable is exposed in the annular space, the distal end of a cylindrical portion of a counter connector can be inserted into the annular space until the vicinity of the cable housing portion, at least a portion of an inner lid is accommodated between standing walls upwardly extending from the hollow portion edge of the insulator, a terminal is disposed on the upper plane of the hollow portion edge of the main body of the insulator, and a contact portion is provided sagging downward from a wire connection portion (refer to Japanese Unexamined Patent Application, First Publication No. 2006-318936). Also, as this type of coaxial connector, a coaxial connector that is constituted from a housing, a bushing mounted in the housing, a socket held in the bushing, and a semi-rigid cable mounted in the socket is known(refer to Japanese Unexamined Patent Application, First Publication No. 2001-307842).

In a conventional RF connector (compact coaxial connector), impedance matching of the coaxial portion (cylindrical portion) is mainly performed. However, in the conventional RF connector, since the distance of the lead attachment portion is short, impedance matching thereof was not performed. In particular, in the soldered portions of the ground shell lead portion, a reinforcing role for ensuring the soldering strength has generally served as the object.

However, in a conventional RF connector, as stated above, remarkable reflection occurred in the soldered portions due to impedance matching of the soldered portions not being particularly performed.

Also, with the increasing performance of electronic devices in recent years, RF connectors corresponding to use in higher-frequency ranges are required.

SUMMARY

In order to solve the aforementioned issues, the first aspect of the present invention is an RF plug connector including: a conductive terminal portion; and an annular conductive coaxial portion that is arranged around the terminal portion, wherein a pair of conductive lead portions extending in the same direction is provided at the outer circumference of the coaxial portion, the terminal portion includes a lead portion that is arranged between the pair of lead portions so as to be parallel to an extension direction thereof, and impedance control is performed by adjusting the distance between the lead portion of the terminal portion and the lead portions of the coaxial portion.

In the first aspect of the present invention, it may be arranged such that the end faces of the pair of lead portions and the end face of the lead portion of the terminal portion are arranged on substantially the same plane. Moreover, it may be arranged such that the end faces of the pair of lead portions project out of the end face of the lead portion of the terminal portion in the extension direction of each lead portion.

A second aspect of the present invention is an RF receptacle connector including: a conductive terminal portion; and an annular conductive coaxial portion that is arranged around the terminal portion, wherein a pair of conductive lead portions extending in the same direction is provided at the outer circumference of the coaxial portion, the terminal portion includes a lead portion that is arranged between the pair of lead portions so as to be parallel to an extension direction thereof, and impedance control is performed by adjusting the distance between the lead portion of the terminal portion and the lead portions of the coaxial portion.

In the aforementioned second aspect, it may be arranged such that the end faces of the pair of lead portions and the end face of the lead portion of the terminal portion are arranged on substantially the same plane. Moreover, it may be arranged such that the end faces of the pair of lead portions project out of the end face of the lead portion of the terminal portion in the extension direction of each lead portion.

A third aspect of the present invention is an RF connector including: a receptacle connector that includes a receptacle-side signal contact portion that includes a lead portion and a terminal portion that is installed in a protruding manner in a portion thereof, and a receptacle-side ground shell portion that includes a pair of lead portions that are arranged on both sides of the receptacle-side signal contact portion and that extend in the same direction and a cylindrical coaxial portion that is connected to the lead portions, and that is integrated with the receptacle-side signal contact portion via an insulating portion so that the terminal portion of the receptacle-side signal contact portion is arranged in the center of the coaxial portion; and a plug connector that includes a plug-side signal contact portion that includes a lead portion and a terminal portion that is installed in a protruding manner in a portion thereof, and a plug-side ground shell portion that includes lead portions that are arranged on both sides of the plug-side signal contact portion and that extend in the same direction and a cylindrical coaxial portion that is connected to said leads, and that is integrated with the plug-side signal contact portion via an insulating portion so that the terminal portion of the plug-side signal contact portion is arranged in the center of the coaxial portion, wherein the terminal portion of the receptacle connector and the terminal portion of the plug connector are capable of being connected by fitting together the coaxial portion of the receptacle connector and the coaxial portion of the plug connector, the lead portion of the receptacle-side signal contact portion is arranged between the pair of leads of the receptacle-side ground shell portion so as to be parallel to an extension direction thereof, and the lead portion of the plug-side signal contact portion is arranged between the pair of leads of the plug-side ground shell portion so as to be parallel to an extension direction thereof.

In the third aspect of the present invention, it may be arranged such that all of the lead portion of the receptacle-side signal contact portion and the lead portions of the receptacle-side ground shell portion are formed to have a plate shape, the lead portions of the receptacle-side ground shell portion project out in a perpendicular direction with respect to the center axis of the coaxial portion of the receptacle-side ground shell portion, and the lead portion of the receptacle-side signal contact portion and the lead portions of the receptacle-side ground shell portion are arranged to be flush. Moreover, it may be arranged such that all of the lead portion of the plug-side signal contact portion and the lead portions of the plug-side ground shell portion are formed to have a plate shape, the lead portions of the plug-side ground shell portion project out in a perpendicular direction with respect to the center axis of the coaxial portion of the plug-side ground shell portion, and the lead portion of the plug-side signal contact portion and the lead portions of the plug-side ground shell portion are arranged to be flush.

In the third aspect of the present invention, it may be arranged such that one surface of the lead portion of the receptacle-side signal contact portion and the lead portions of the receptacle-side ground shell portion, or one surface of the lead portion of the plug-side signal contact portion and the lead portions of the plug-side ground shell portion is arranged to be flush, and the receptacle connector or the plug connector is capable of being connecting to a pattern of a circuit board with these one surfaces serving as soldered surfaces. Moreover, it may be arranged such that the end faces of the lead portions of the receptacle-side ground shell portion and the plug-side ground shell portion and the end faces of the leads of the receptacle-side signal contact portion and the plug-side signal contact portion are arranged on substantially the same plane, respectively. Further, it may be arranged such that the end faces of the lead portions of the receptacle-side ground shell portion and the plug-side ground shell portion project out of the end face of the leads of the receptacle-side signal contact portion and the plug-side signal contact portion, respectively, in the extension direction of each lead portion.

In the connector according to the present invention, matching of impedance is easy in the portion between the terminal portion and the coaxial portion since the lead portions of the coaxial portion are arranged on both sides of the lead portion of the terminal portion, and impedance control is performed by adjusting the distance between the lead portion of the terminal portion and the lead portions of the coaxial portion. As a result, it is possible to achieve a structure that is advantageous for use in the high-frequency range by suppressing the generation of signal reflections in the portion.

Further, the receptacle connector is constituted by the receptacle-side signal contact portion and the receptacle-side ground shell portion being integrated so that the terminal portion is arranged in the center of the coaxial portion, and the lead portion of the signal contact portion is arranged between the pair of lead portions that are provided in the ground shell portion and that extend in the same direction. Also, the plug connector is constituted by the plug-side signal contact portion and the plug-side ground shell portion being integrated so that the terminal portion is arranged in the center of the coaxial portion, and the lead portion of the signal contact portion is arranged between the pair of lead portions that are provided in the ground shell portion and that extend in the same direction. Thereby, it is possible to perform impedance control by adjusting the distance between the lead portions, i.e., between either of the lead portions of the receptacle connector and the lead portions of the plug connector. As a result, matching of impedance is easy in both the receptacle connector and the plug connector, and it is possible to achieve a structure that is advantageous for use in the high-frequency range by suppressing the generation of signal reflections in these portions.

Moreover, since the lead portions of the signal contact portions and the lead portions of the ground shell portions are flush, it is possible to accurately and reliably perform impedance control by adjustment between the lead portions, which is advantageous in the high-frequency range. Accordingly, it is possible to significantly improve the high-frequency characteristic (VSWR). Further it is possible to enable use in a higher-frequency range (for example 16 GHz) than previously.

Moreover, if the one surface of the lead portions according to the present invention serves as soldered surfaces, it is possible to perform impedance matching of the soldered portions while maintaining the soldering strength and achieve excellent high-frequency characteristic, compared to a conventional RF connector.

DETAILED DESCRIPTION OF THE PREFERRED EMBODIMENTS

Hereinafter, an RF connector according to an embodiment of the present invention shall be described.

Note that the embodiment is described in detail in order to better comprehend the gist of the invention, and unless otherwise noted, shall not serve to limit the present invention.

Figure 1:
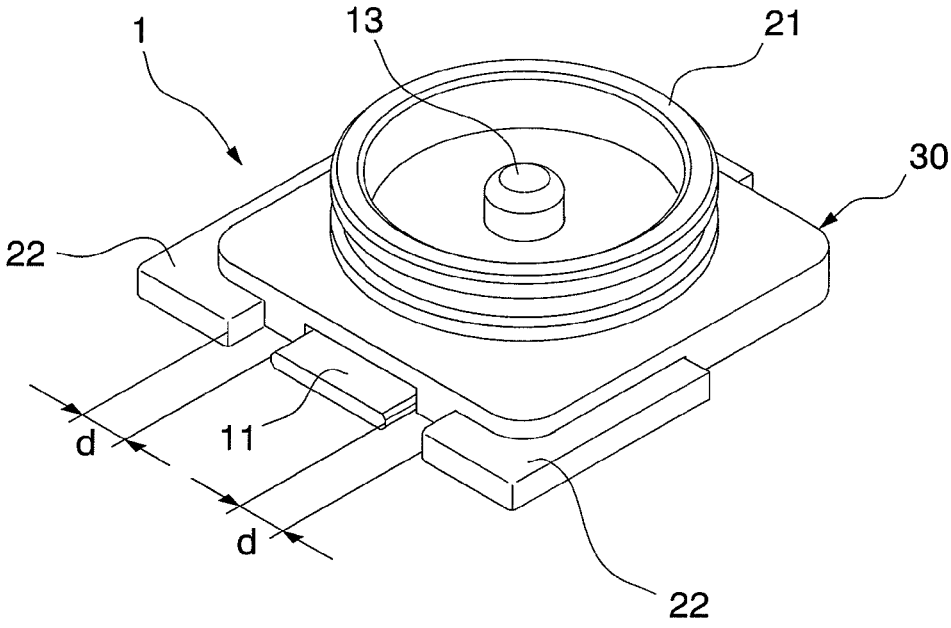
FIG. 1 is a perspective view showing a receptacle connector that constitutes the RF connector according to an embodiment of the present invention.
Figure 2:
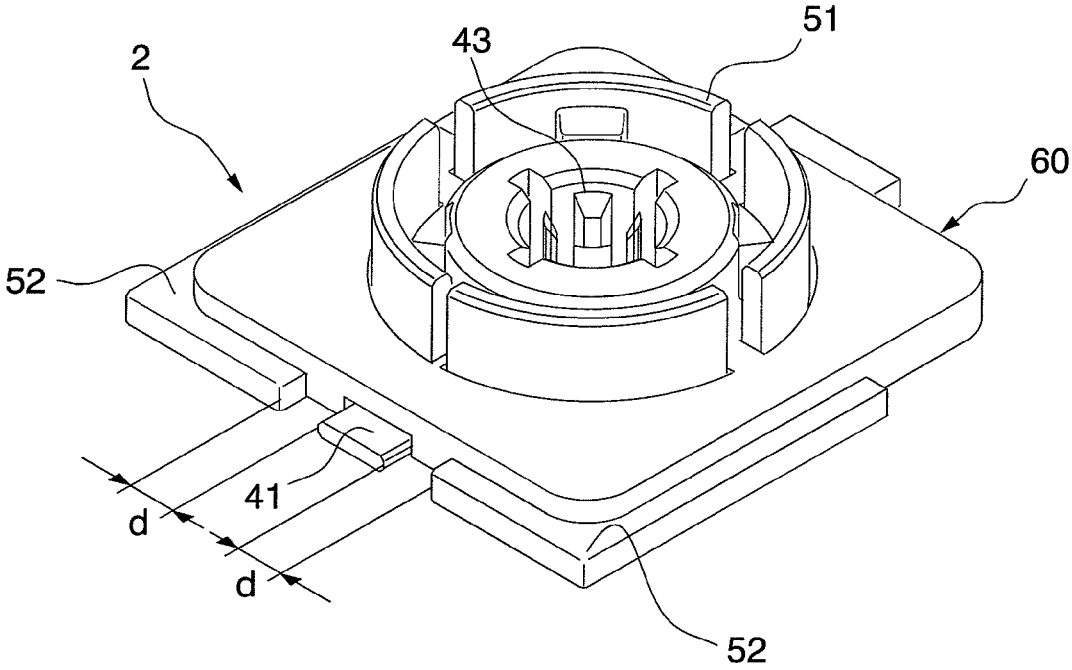
FIG. 2 is a perspective view showing a plug connector that constitutes the RF connector according to the embodiment.
Figure 3:
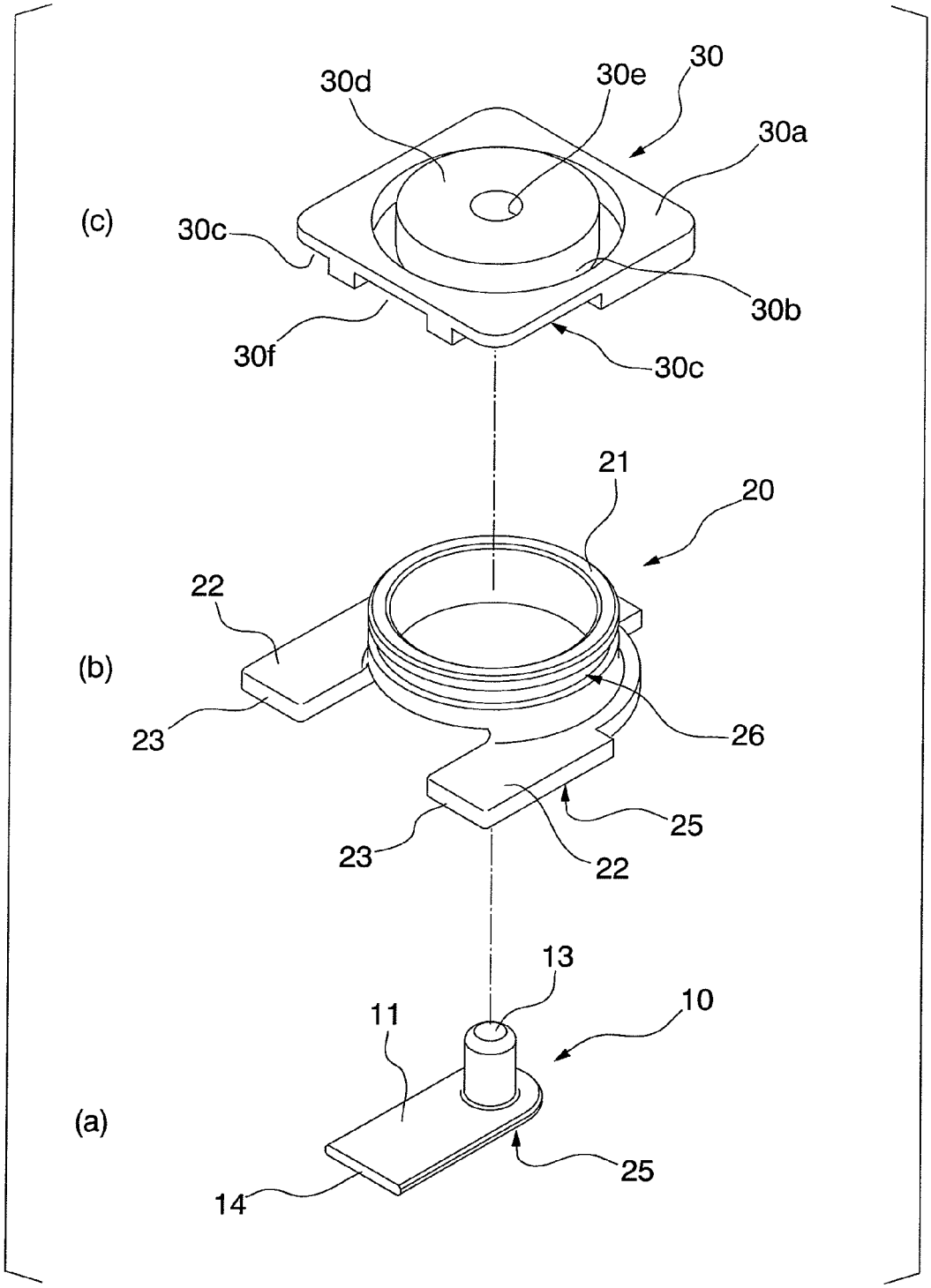
FIG. 3 is a perspective view showing a receptacle-side signal contact portion according to the embodiment.
Figure 4:
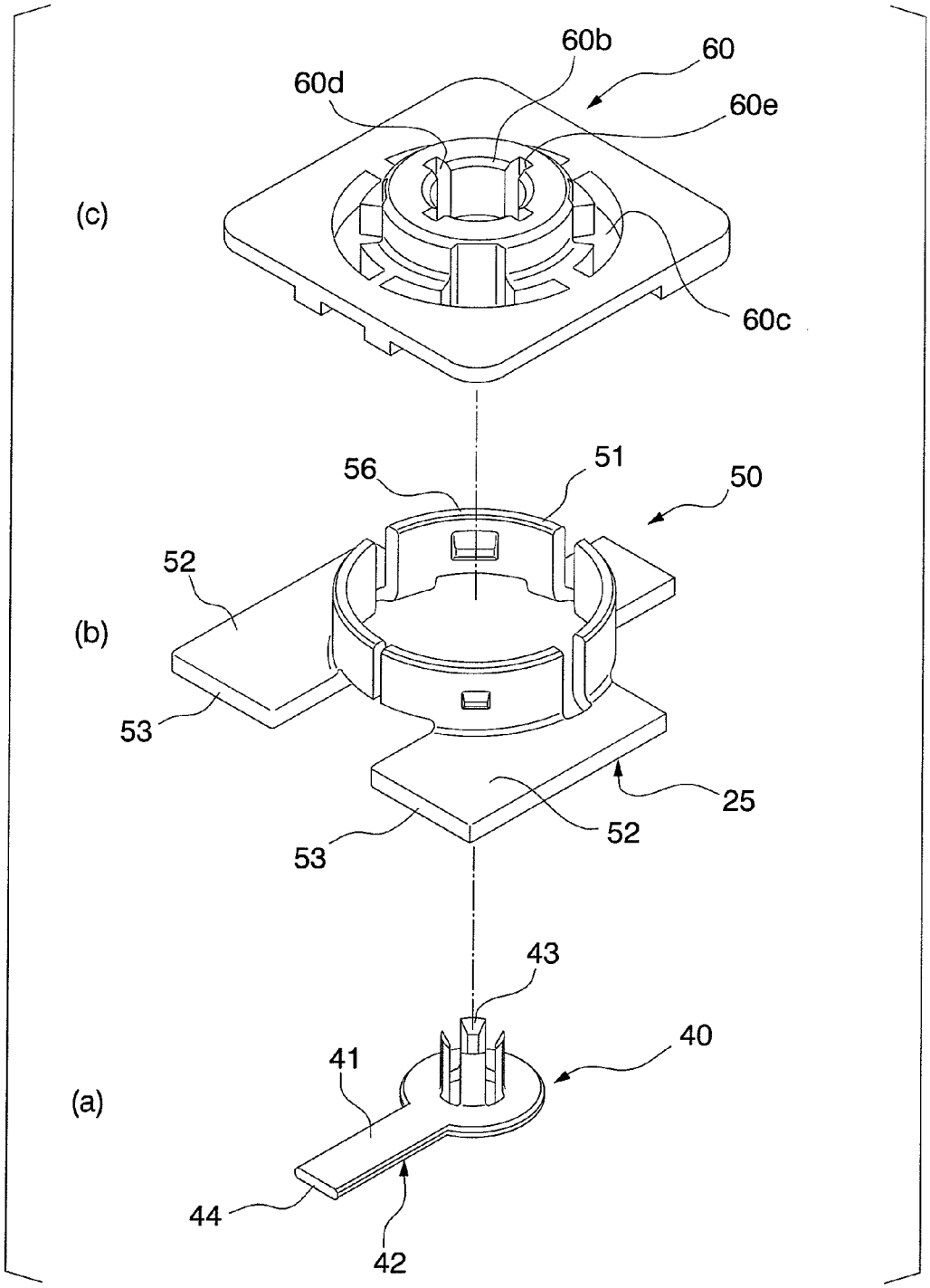
FIG. 4 is a perspective view showing a plug-side signal contact portion according to the embodiment.

FIG. 1 and FIG. 2 are figures that show outlines of the RF connector according to the embodiment of the present invention. The RF connector of the present embodiment consists of a receptacle connector 1 and a plug connector 2. The receptacle connector 1 and the plug connector 2 are mounted on separate circuit boards. When the receptacle connector 1 and the plug connector 2 are integrally joined, the substrates on which the connectors are mounted become electrically connected. FIG. 3 and FIG. 4 show schematic exploded perspective views of the receptacle connector 1 and the plug connector 2.

The receptacle connector 1 is constituted from a receptacle-side signal contact portion 10 shown in (a) of FIG. 3, a receptacle-side ground shell portion 20 shown in (b) of FIG. 3, and an insulating portion 30 shown in (c) of FIG. 3. The receptacle connector 1 may be obtained by integrally molding the receptacle-side signal contact portion 10, the receptacle-side ground shell portion 20 and the insulating portion 30 by insert molding.

A lead portion 11 of the receptacle-side signal contact portion 10 is formed from a conductor such as copper alloy having substantially a rectangular plate shape. One surface of the lead portion 11 is a soldered portion 12 that is soldered to the circuit board. On a surface on the opposite side of the lead portion 11, a terminal portion 13 having substantially a cylindrical shape is provided so as to project out toward the opposite side of the soldered portion in the normal direction of the surface. This terminal portion 13 may be integrally formed with the lead portion 11 by drawing, or they may be integrally joined after being formed as separate components.

A lead portion 22 of the receptacle-side ground shell portion 20 is formed from a plate-shaped conductor having substantially a U-shape such as a copper alloy. One surface of each lead portion 22 is a soldered portion 25 that is soldered to the circuit board. On the surface on the opposite side a coaxial portion 21 with a cylindrical shape is provided so as to project out toward the opposite side of the soldered portion in the normal direction of the surface. Moreover, a semicircular portion 22*a* of the U-shaped lead portion 22 and the outer circumference of the coaxial portion 21 are formed so as to be integrated. This coaxial portion 21 may also be integrally formed with the lead portion 22 by drawing, or they may be integrally joined after being formed as separate components.

The insulating portion 30 is formed in a plate shape by an insulator such as resin or the like, and houses the receptacle-side signal contact portion 10 and the receptacle-side ground shell portion 20 so that the terminal portion 13 of the receptacle-side signal contact portion 10 and the coaxial portion 21 of the receptacle-side ground shell portion 20 are arranged in a coaxial manner while electrically insulating them from each other.

The lead portion 22 of the receptacle-side ground shell portion 20 is arranged so as to be separated by a predetermined distance from the lead portion 11 on both sides of the lead portion 11 of the receptacle-side signal contact portion 10. Also, an end face 14 of the lead portion 11 and end face 23 of the lead portion 22 project out of the side surface of a main body portion 30*a* of the insulating portion 30 toward the outer side along the longitudinal axis (extension direction) of the lead portion 11. The end face 14 and the end face 23 of the respective lead portions are arranged on the same plane.

The insulator 30 has a hole portion 30*b* that is formed in the center of the plate-shaped main body portion 30*a*, and is integrated with the receptacle-side ground shell portion 20 by inserting the coaxial portion 21 of the receptacle-side ground shell portion 20 into the hole portion 30*b*. Also, a groove portion 30*c* that partially contains the lead portions 22, 22 is formed on both sides of the bottom surface of the insulator 30 that faces the receptacle-side ground shell portion 20. In the state of the insulator 30 and the receptacle-side ground shell portion 20 being integrated by inserting the coaxial portion 21 of the receptacle-side ground shell portion 20 in the hole portion 30*b*, the lead portion 22, 22 partially project out of the insulator 30 at the both sides thereof. Also, a doughnut-plate shaped insulating member 30*d* is inserted inside the coaxial portion 21 that is placed inside the hole portion 30*b*, and the terminal portion 13 is inserted into a hole portion 30*e* in the center of the insulating portion 30*d*, whereby the receptacle-side signal contact portion 10 is mounted on the insulator 30. Also, a housing groove 30*f* is formed in the middle of the bottom portion of the insulating portion 30 so as to be positioned between the groove portions 30*c*, 30*c*, and the lead portion 11 of the receptacle-side signal contact portion 10 is fitted in the housing groove 30*f*. The distal end portion of the lead portion 11 projects out slightly of the insulator 30.

On the other hand, the plug connector 2 consists of a plug-side signal contact portion 40 shown in (a) of FIG. 4, a plug-side ground shell portion 50 shown in (b) of FIG. 4, and an insulating portion 60 shown in (c) of FIG. 4. The plug-side signal contact portion 40 and the plug-side ground shell portion 50 have a complementary shape with the receptacle-side signal contact portion 10 and the receptacle-side ground shell portion 20, respectively. Also, the plug connector 2 may be obtained by integrally molding the plug-side signal contact portion 40, the plug-side ground shell portion 50, and the insulating portion 60.

A terminal portion 43 of the plug-side signal contact portion 40 is provided so as to project from the surface of the opposite side of a soldered portion 42 of a lead portion 41, which is formed with a conductor having substantially a rectangular plate shape, toward the opposite side of the soldered portion in the normal direction of the surface. The terminal portion 43 is substantially cylindrical, but it may be split into a plurality of portions at equal angles along the center axis of the terminal portion 43 in the radial direction (it is split in the example of (a) of FIG. 4). The terminal portion 43 may be integrally formed with the lead portion 41 by press working or the like, or they may be integrally joined after being formed as separate components.

A coaxial portion 51 of the plug-side ground shell portion 50 is provided so as to project out of the surface on the opposite side of a soldered portion 55 of a lead portion 52, which is formed with a plate-shaped conductor having substantially a U-shape, toward the opposite side of the soldered portion in the normal direction of the surface. The coaxial portion 51 is also substantially cylindrical, and is split into a plurality of portions at equal angles along the center axis of the coaxial portion 51 in the radial direction. Moreover, the semicircular portion of the lead portion 52 and the circular arc of the coaxial portion 51 are formed so as to match. This coaxial portion 51 may also be integrally formed with the lead portion 52 by press working or the like, or they may be integrally joined after being formed as separate components.

The insulating portion 60 is formed in a plate shape by an insulator such as resin or the like, and houses the plug-side signal contact portion 40 and the plug-side ground shell portion 50 so that the terminal portion 43 of the plug-side signal contact portion 40 and the coaxial portion 51 of the plug-side ground shell portion 50 are arranged in a coaxial manner while electrically insulating them from each other.

The insulating portion 60 has a cylindrical projection portion 60*b* in the center of a plate-shaped main body portion 60*a*, and a fitting hole 60*c* that allows insertion of the coaxial portion 51 of the plug-side ground shell portion 50 is formed on the outer periphery side of the projection portion 60*b*. The terminal portion 43 of the plug-side signal contact portion 40 is capable of being inserted into the inner side of the projection portion 60*b*. A round hole portion 60*d* inside the projection portion 60*b* has an inner diameter that allows insertion of the terminal portion 13 of the aforementioned receptacle-side signal contact portion, and four vertical groove portions 60*e* are formed on the inner circumference portion of the hole portion 60*d*. The terminal portion 43 of the plug-side signal contact portion 40 that is divided into four is inserted into the groove portions 60*e*. That is, by fitting the upper portion of the coaxial portion 51 of the plug-side ground shell portion 50 into the fitting hole 60*c* of the insulating portion 60, and inserting the upper portion of the terminal 43 of the plug-side signal contact portion 40 in the groove portions 60*e*, the insulating portion 60, the plug-side ground shell portion 50, and the plug-side signal contact portion 40 are integrated as shown in FIG. 2. Note that in the state shown in FIG. 2, the lead portion 52 of the plug-side ground shell portion 50 and the lead portion 41 of the plug-side signal contact portion 40 slightly project out from the insulating portion 60.

The lead portion 52 of the plug-side ground shell portion 50 is also arranged to be separated by a predetermined distance d from the lead portion 41 (refer to FIG. 1 and FIG. 2) on both sides of the lead portion 41 of the plug-side signal contact portion 40. Also, an end face 44 of the lead portion 41 and end face 53 of the lead portion 52 slightly project out of the side portion of the insulating portion 60 to the outside along the longitudinal axis (extension direction) of the lead portion 41. The end face 44 and the end faces 53 are arranged on the same plane.

The RF connector according to the present invention can perform impedance matching of the lead portions by adjusting the aforementioned distance d. By changing this distance d, it is possible to adjust the impedance of the lead portions to a desired value.

Also, according to the results of electromagnetic field simulations that the inventors have performed using the structure of the present embodiment, it is found that the high-frequency characteristic is improved if the lead end faces 23, 53 of the ground shell portions 20, 50 project out approximately 0.5 mm from the end faces 14, 44 of the signal contact portions 10, 40 in the extension direction of each lead portion. Accordingly, the lead end faces 23, 53 of the ground shell portions 20, 50 may project out approximately 0.5 mm from the end faces 14, 44 of the signal contact portions 10, 40 in the extension direction of each lead portion.

Figure 5:
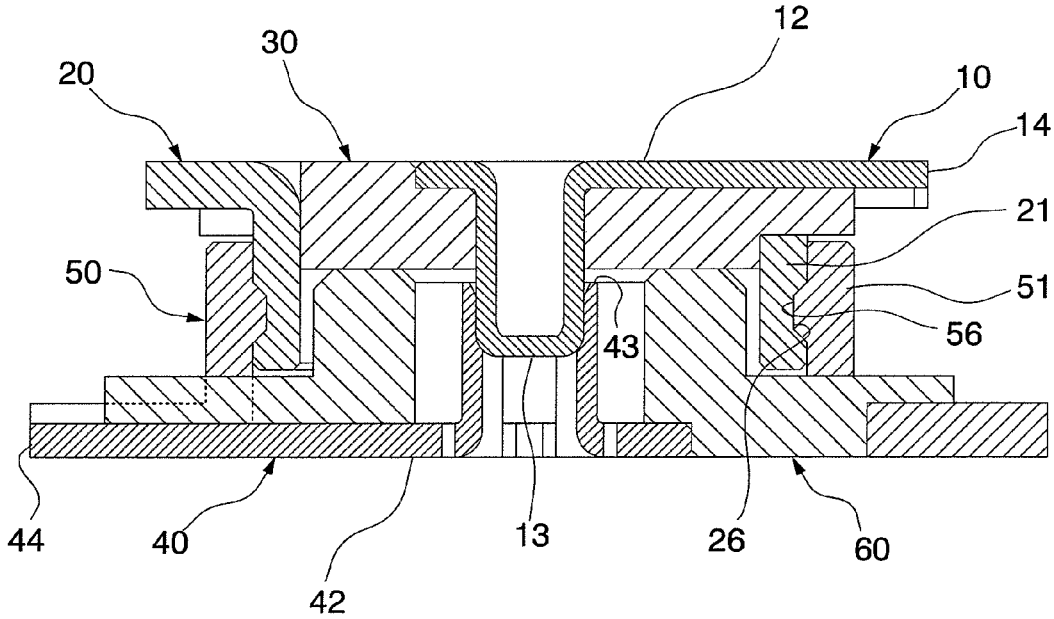
FIG. 5 is a longitudinal sectional view showing the RF connector in the engaged state according to the embodiment.
Figure 6:
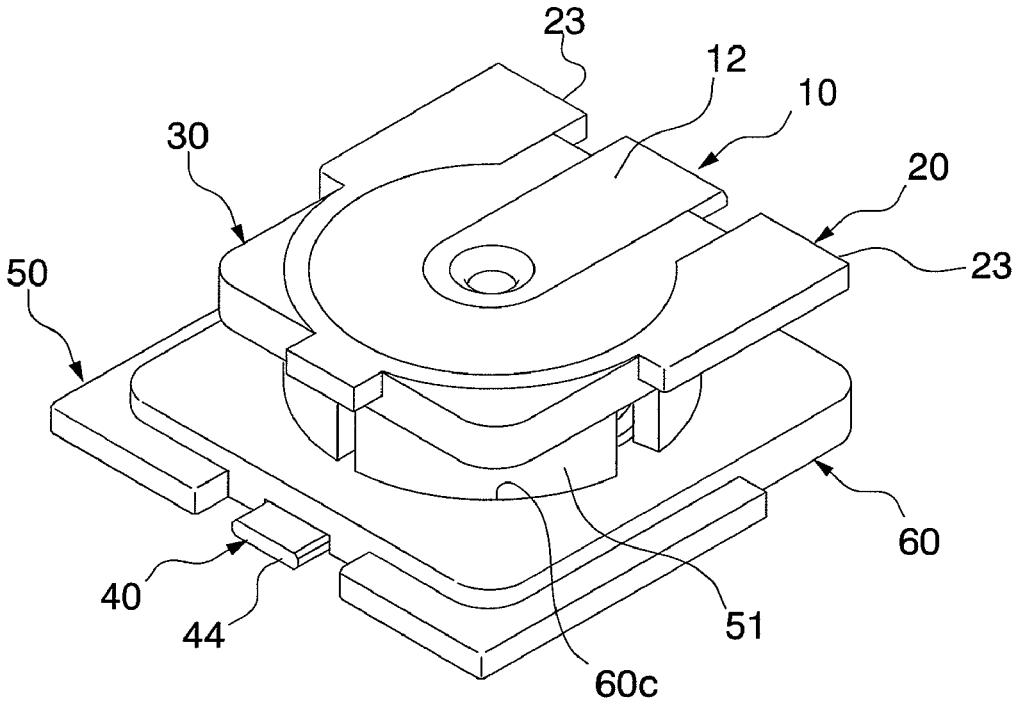
FIG. 6 is a perspective view seen from the receptacle connector side showing the RF connector in the engaged state according to the embodiment.
Figure 7:
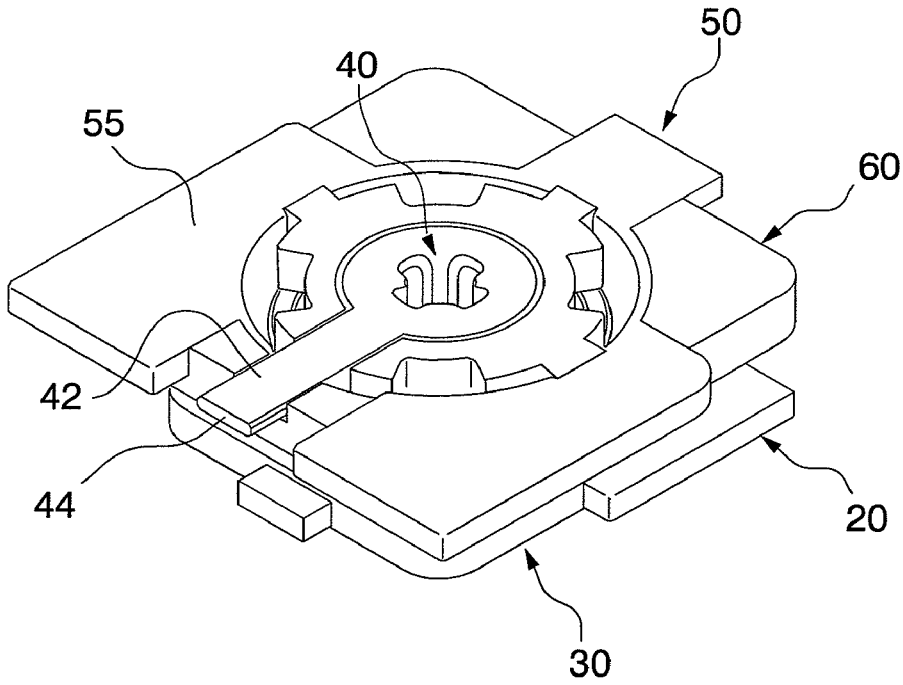
FIG. 7 is a perspective view seen from the plug connector side showing the RF connector in the engaged state according to the embodiment.
Figure 8:
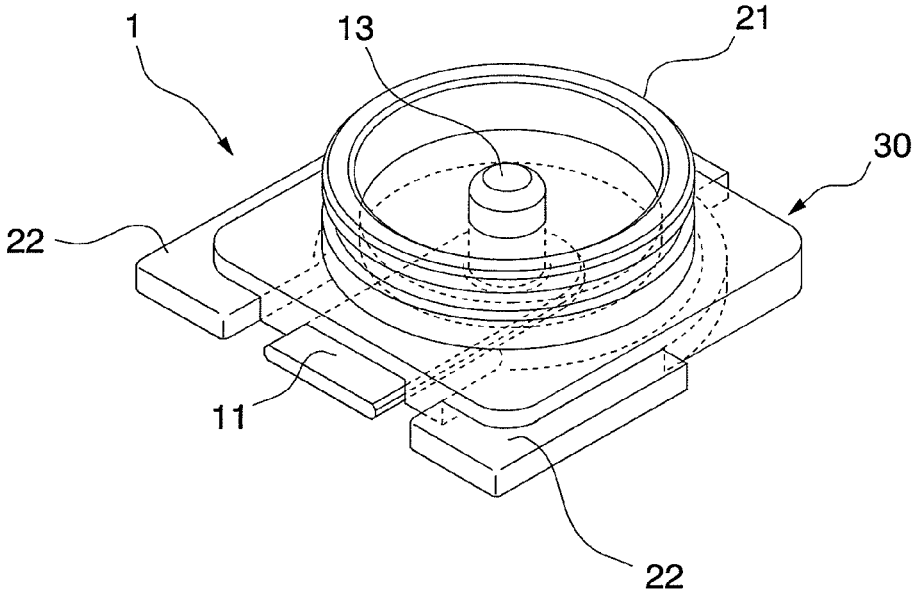
FIG. 8 is a perspective view showing a receptacle connector that constitutes the RF connector according to the embodiment.
Figure 9:
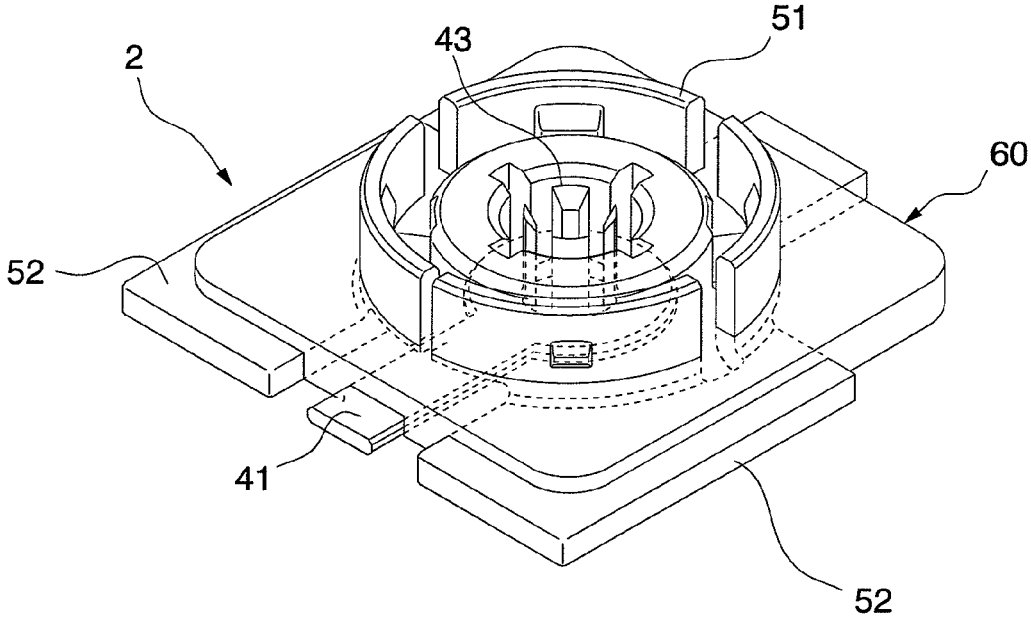
FIG. 9 is a perspective view showing a plug connector that constitutes the RF connector according to the embodiment.

Moreover, a groove portion 26 is formed on the outer circumferential surface of the coaxial portion 21 of the receptacle-side ground shell portion 20, and one or more projection portion 56 may be formed on the inner circumferential surface of the coaxial portion 51 of the plug-side ground shell portion 50 at a height corresponding to that of the groove portion 26. When the receptacle connector 1 and the plug connector 2 are fitted together (refer to FIG. 5, FIG. 6, and FIG. 7), the projection portion 56 fits into the groove portion 26, whereby unexpected detachment between the receptacle connector 1 and the plug connector 2 is prevented.

In the connector according to the present invention, since the lead portions 22, 52 of the coaxial portions are arranged on both sides of the lead portions 11, 41 of the terminal portions, and impedance control is performed by adjusting the distance between the lead portions 11, 41 of the terminal portions and the lead portions 22, 52 of the coaxial portions, matching of impedance is easy in the portion between the terminal portions 13, 43 and the coaxial portions 21, 51, and it is possible to achieve a structure that is advantageous for use in the high-frequency range by suppressing the generation of signal reflections in the portion.

Also, the receptacle connector 1 is constituted by the receptacle-side signal contact portion 10 and the receptacle-side ground shell portion 20 being integrated so that the terminal portion 13 is arranged in the center of the coaxial portion 21, and the lead portion 11 of the signal contact portion is arranged between the pair of lead portions 22, 22 that are provided in the ground shell portion and that extend in the same direction. Moreover, the plug connector 2 is constituted by the plug-side signal contact portion 40 and the plug-side ground shell portion 50 being integrated so that the terminal portion 43 is arranged in the center of the coaxial portion 51, and the lead portion 41 of the signal contact portion is arranged between the pair of lead portions 52, 52 that are provided in the ground shell portion and that extend in the same direction. Thereby, it is possible to perform impedance control by adjusting the distance between the lead portions, i.e., between either of the lead portions of the receptacle connector 1 and the lead portions of the plug connector 2. As a result, matching of impedance is easy in both the receptacle connector 1 and the plug connector 2, and it is possible to achieve a structure that is advantageous for use in the high-frequency range by suppressing the generation of signal reflections in these portions.

Moreover, since the lead portions 11, 41 of the signal contact portions and the lead portions 22, 52 of the ground shell portions are flush, it is possible to accurately and reliably perform impedance control by adjustment between the lead portions, which is advantageous in the high-frequency range. Accordingly, it is possible to significantly improve the high-frequency characteristic (VSWR). Further, it is possible to enable use in a higher frequency range (for example 16 GHz) than previously.

Moreover, if the one surface of the lead portions according to the present invention serves as soldered surfaces, it is possible to perform impedance matching of the soldered portions while maintaining the soldering strength and achieve excellent high-frequency characteristic, compared to a conventional RF connector.

What is claimed is:

1. An RF plug connector comprising:

a conductive terminal portion; and an annular conductive coaxial portion that is arranged around the terminal portion, wherein a pair of conductive lead portions extending in the same direction is provided at the outer circumference of the coaxial portion, the terminal portion comprises a lead portion that is arranged between the pair of lead portions so as to be parallel to an extension direction thereof, impedance control is performed by adjusting the distance between the lead portion of the terminal portion and the lead portions of the coaxial portion, and the end faces of the pair of lead portions and the end face of the lead portion of the terminal portion are arranged on substantially the same plane.

2. An RF plug connector comprising:

a conductive terminal portion; and an annular conductive coaxial portion that is arranged around the terminal portion, wherein a pair of conductive lead portions extending in the same direction is provided at the outer circumference of the coaxial portion, the terminal portion comprises a lead portion that is arranged between the pair of lead portions so as to be parallel to an extension direction thereof, impedance control is performed by adjusting the distance between the lead portion of the terminal portion and the lead portions of the coaxial portion, and the end faces of the pair of lead portions project out of the end face of the lead portion of the terminal portion in the extension direction of each lead portion.

3. An RF receptacle connector comprising:

a conductive terminal portion; and an annular conductive coaxial portion that is arranged around the terminal portion, wherein a pair of conductive lead portions extending in the same direction is provided at the outer circumference of the coaxial portion, the terminal portion comprises a lead portion that is arranged between the pair of lead portions so as to be parallel to an extension direction thereof, impedance control is performed by adjusting the distance between the lead portion of the terminal portion and the lead portions of the coaxial portion, and the end faces of the pair of lead portions and the end face of the lead portion of the terminal portion are arranged on substantially the same plane.

4. An RF receptacle connector comprising:

a conductive terminal portion; and an annular conductive coaxial portion that is arranged around the terminal portion, wherein a pair of conductive lead portions extending in the same direction is provided at the outer circumference of the coaxial portion, the terminal portion comprises a lead portion that is arranged between the pair of lead portions so as to be parallel to an extension direction thereof, impedance control is performed by adjusting the distance between the lead portion of the terminal portion and the lead portions of the coaxial portion, and the end faces of the pair of lead portions project out of the end face of the lead portion of the terminal portion in the extension direction of each lead portion.

5. An RF connector comprising:

a receptacle connector that comprises a receptacle-side signal contact portion that comprises a lead portion and a terminal portion that is installed in a protruding manner in a portion thereof, and a receptacle-side ground shell portion that comprises a pair of lead portions that are arranged on both sides of the receptacle-side signal contact portion and that extend in the same direction and a cylindrical coaxial portion that is connected to the lead portions, and that is integrated with the receptacle-side signal contact portion via an insulating portion so that the terminal portion of the receptacle-side signal contact portion is arranged in the center of the coaxial; and a plug connector that comprises a plug-side signal contact portion that comprises a lead portion and a terminal portion that is installed in a protruding manner in a portion thereof, and a plug-side ground shell portion that comprises lead portions that are arranged on both sides of the plug-side signal contact portion and that extend in the same direction and a cylindrical coaxial portion that is connected to said leads, and that is integrated with the plug-side signal contact portion via an insulating portion so that the terminal portion of the plug-side signal contact portion is arranged in the center of the coaxial portion, wherein the terminal portion of the receptacle connector and the terminal portion of the plug connector are capable of being connected by fitting together the coaxial portion of the receptacle connector and the coaxial portion of the plug connector the lead portion of the receptacle-side signal contact portion is arranged between the pair of leads of the receptacle-side ground shell portion so as to be parallel to an extension direction thereof, the lead portion of the plug-side signal contact portion is arranged between the pair of leads of the plug-side ground shell portion so as to be parallel to an extension direction thereof, and the end faces of the lead portions of the receptacle-side ground shell portion and the plug-side ground shell portion and the end faces of the leads of the receptacle-side signal contact portion and the plug-side signal contact portion are arranged on substantially the same plane, respectively.

6. An RF connector comprising:

a receptacle connector that comprises a receptacle-side signal contact portion that comprises a lead portion and a terminal portion that is installed in a protruding manner in a portion thereof, and a receptacle-side ground shell portion that comprises a pair of lead portion that are arranged on both sides of the receptacle-side signal contact portion and that extend in the same direction and a cylindrical coaxial portion that is connected to the lead portions, and that is integrated with the receptacle-side signal contact portion via an insulating portion so that the terminal portion of the receptacle-side signal contact portion is arranged in the center of the coaxial portion; and a plug connector that comprises a plug-side signal contact portion that comprises a lead portion and a terminal portion that is installed in a protruding manner in a portion thereof, and a plug-side ground shell portion that comprises lead portions that are arranged on both sides of the plug-side signal contact portion and that extend in the same direction and a cylindrical coaxial portion that is connected to said leads, and that is integrated with the plug-side signal contact portion via an insulating portion so that the terminal portion of the plug-side signal contact portion is arranged in the center of the coaxial portion, wherein the terminal portion of the receptacle connector and the terminal portion of the plug connector are capable of being connected by fitting together the coaxial portion of the receptacle connector and the coaxial portion of the plug connector, the lead portion of the receptacle-side signal contact portion is arranged between the pair of leads of the receptacle-side ground shell portion so as to be parallel to an extension direction thereof, the lead portion of the plug-side signal contact portion is arranged between the pair of leads of the plug-side ground shell portion so as to be parallel to an extension direction thereof, and the end faces of the lead portions of the receptacle-side ground shell portion and the plug-side ground shell portion project out of the end face of the leads of the receptacle-side signal contact portion and the plug-side signal contact portion, respectively, in the extension direction of each lead portion.

* * * * *